US008851655B2

(12) United States Patent
Velasco et al.

(10) Patent No.: US 8,851,655 B2
(45) Date of Patent: Oct. 7, 2014

(54) PRODUCING A HOT-AIR FLOW IN A PRINTER TO HEAT A PRINT MEDIA

(75) Inventors: Antonio Monclus Velasco, Castelldefels Barcelona (ES); Jesús Garcia Maza, Terrassa Barcelona (ES); Xavier Soler Pedemonte, Barcelona (ES); Francisco Javier Rodriguez Escañuela, Mataro (ES); Elena Laso Plaza, Barcelona (ES); Fco Javier Pérez Gellida, Sant Cugat (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 171 days.

(21) Appl. No.: 13/561,581

(22) Filed: Jul. 30, 2012

(65) Prior Publication Data

US 2014/0028767 A1 Jan. 30, 2014

(51) Int. Cl.
*B41J 2/01* (2006.01)

(52) U.S. Cl.
USPC ..... 347/102; 347/101; 347/17

(58) Field of Classification Search
None
See application file for complete search history.

(56) References Cited

U.S. PATENT DOCUMENTS

| | | | | |
|---|---|---|---|---|
| 5,020,244 | A * | 6/1991 | Smith | 34/633 |
| 5,086,700 | A * | 2/1992 | Van Den Berg | 101/424.1 |
| 5,717,446 | A * | 2/1998 | Teumer et al. | 347/35 |
| 6,463,674 | B1 * | 10/2002 | Meyers et al. | 34/304 |
| 6,863,393 | B2 * | 3/2005 | Patterson et al. | 347/102 |
| 7,086,727 | B2 * | 8/2006 | Nishikawa et al. | 347/102 |
| 7,187,856 | B2 * | 3/2007 | Atkins | 392/484 |
| 7,354,146 | B2 * | 4/2008 | Yraceburu et al. | 347/102 |
| 8,042,727 | B2 * | 10/2011 | Shirai et al. | 228/234.1 |
| 8,459,790 | B2 * | 6/2013 | Hara et al. | 347/104 |
| 8,590,173 | B1 * | 11/2013 | Mengle | 34/259 |
| 2002/0067403 | A1 * | 6/2002 | Smith | 347/104 |
| 2003/0084811 | A1 * | 5/2003 | Ishii et al. | 101/494 |
| 2003/0156177 | A1 * | 8/2003 | Nishikawa et al. | 347/102 |
| 2005/0253912 | A1 * | 11/2005 | Smith et al. | 347/102 |
| 2010/0149298 | A1 * | 6/2010 | Fujioka et al. | 347/104 |
| 2011/0267410 | A1 * | 11/2011 | Yamamoto et al. | 347/102 |

FOREIGN PATENT DOCUMENTS

JP 2005308377 A 11/2005

OTHER PUBLICATIONS

Buchlin, J.M.; "Convective Heat Transfer in Impinging-gas-jet Arrangements"; Journal of Applied Fluid Mechanics; 2011; pp. 137-149; vol. 4; Issue 1; http://www.jafmonline.net/modules/journal/iafmonline4doai.php?E.Isrcld=188.

* cited by examiner

*Primary Examiner* — Laura Martin
*Assistant Examiner* — Leonard S Liang

(57) ABSTRACT

A printer comprises a heating system to produce a hot-air flowimpinging on a print media, the heating system comprising a heat source, a fan, and an air chamber. The air chamber has an air-impinging plate with air-impinging holes adjacent to the print media. The heating system provides first and second partially overlapping hot-air circulation circuits. The first hot-air circulation circuit leads from the heater through the holes of the air-impinging plate to direct hot air through the air-impinging holes to the print media in the course of printing operation. The second hot-air circulation circuit leads back to the heater through a recirculation channel without passing through the air-impinging holes of the air-impinging plate to prevent air from being directed onto the print media, in the course of the heat-up operation. The heating system further comprises circuit-switching arranged to switch the air flow between the first and second hot-air circulation circuits.

18 Claims, 7 Drawing Sheets

PRODUCING A HOT-AIR FLOW IN A PRINTER TO HEAT A PRINT MEDIA

FIELD OF THE INVENTION

The invention relates to producing a hot-air flow in a printer impinging on a print media.

SUMMARY OF THE INVENTION

An example of the invention provides a printer comprising a heating system to produce a hot-air flow impinging on a print media. The heating system comprises a heat source, a fan and an air chamber comprising an air-impinging plate with air-impinging holes adjacent to the print media, wherein the heating system provides first and second partially overlapping hot-air circulation circuits. The first hot-air circulation circuit leads from the heater through the holes of the air-impinging plate to direct hot air through the air-impinging holes to the print media in the course of printing operation. The second hot-air circulation circuit leads back to the heater through a recirculation channel without passing through the air-impinging holes of the air-impinging plate to prevent air being directed onto the print media, in the course of the heating-up operation. The heating system further comprises a circuit-switching device arranged to switch the air flow between the first and second hot-air circulation circuits.

According to another example, a method is provided of producing a hot-air flow in a printer impinging on a print media with a heat source, a fan and an air chamber comprising an air-impinging plate with air-impinging holes adjacent to the print media. The method provides first and second partially overlapping hot-air circulation circuits, wherein the first hot-air circulation circuit leads from the heater through the holes of the air-impinging plate to direct hot air through the holes to the print media in the course of printing operation, and the second hot-air circulation circuit leads back to the heater through a recirculation channel without passing through the holes of the air-impinging plate to prevent air from being directed onto the print media, in the course of the heating-up operation. The method further comprises circuit-switching to switch the air flow between the first and second hot-air circulation circuits.

BRIEF DESCRIPTION OF THE DRAWINGS

Examples of the present invention will now be described, by way of example only, with reference to the accompanying drawings in which corresponding reference numerals indicate corresponding items, and in which.

The drawings and the description of the drawings are examples of the invention and not of the invention itself.

DETAILED DESCRIPTION

Figure 1:
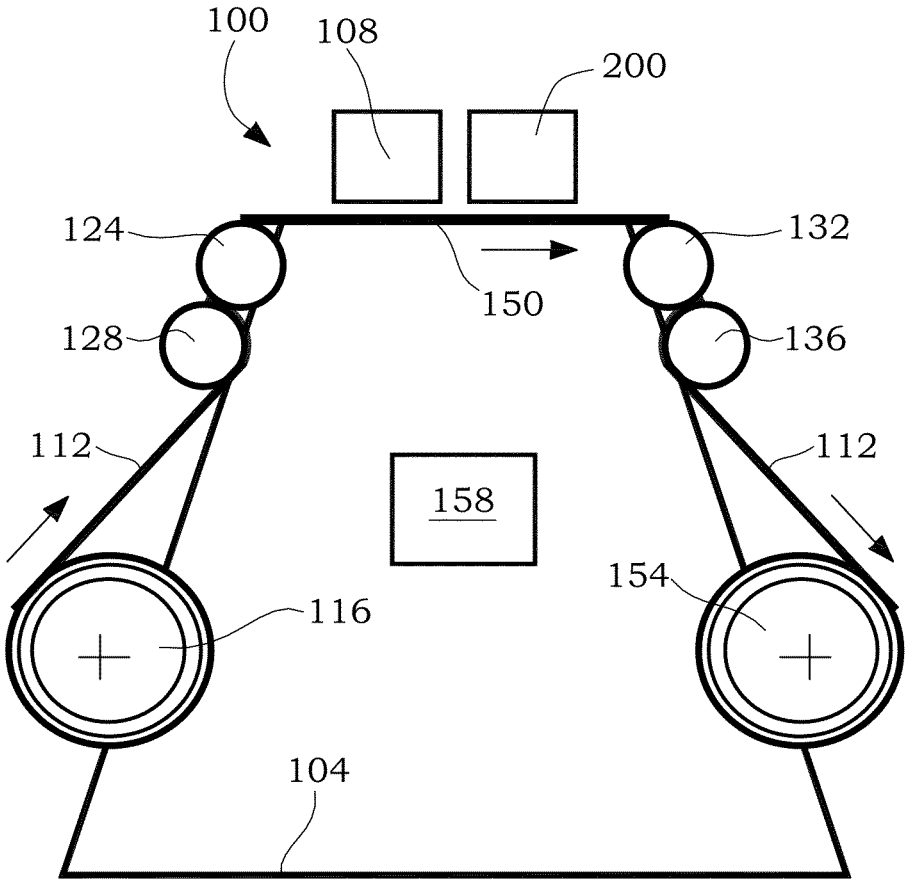
FIG. 1 shows a schematic diagram of a printer with a heating system of an example.

FIG. 1 is a schematic illustration of a printer in the form of a wide format printer. Printer 100 includes a rigid frame 104 on which a print-head 108 is arranged for moving in a reciprocating type of movement across a flexible substrate or print media 112. Typically, this reciprocating movement, which is often referred to as swathing, is in a direction perpendicular to the drawing plane of FIG. 1. Heat sources for ink curing and/or ink drying may be attached to or near the print-head 108 and may move in the same reciprocating movement as the print-head 108 or may have separate drives or, may be stationary. In general, a heating system is arranged to dry and/or cure ink which is printed on the print media, for example for current latex-based inks. A heating system for ink drying is exemplified at 200. This heating system produces a hot-air flow to heat a print media as described later in detail. Alternatively, the heating system could be applied also to a printer which is arranged for printing rigid media. When the heating system is stationary, it typically will extend over the width of the print media, or at least over the width of a printed region of the same.

In the printer as exemplified in FIG. 1, mounted on the frame 104 there are components of a feed-path for the substrate or print media 112 which include a substrate supply-roll 116, a substrate drive-roll 124 and, associated with the substrate drive-roll 124, a first or drive-roll pressure-roll 128. Spaced apart from the drive-roll 124, there is arranged a substrate tension-providing-roll 132 and, associated with the substrate tension-providing-roll 132, a second pressure-roll 136. The drive-roll 124, the first pressure roll 128, the tension-providing-roll 132 and the second pressure-roll 136 span at least the width of the substrate 112 on which printing is performed. For example, in the case of a wide format printer, the substrate may be 5 meters (5000 mm) wide and the rolls 124, 128, 132 and 136 will be of a similar length. Since the rolls are relatively long, each of them, or some of them, may be supported by a series of clamping rolls for applying a support force directly to the surface of the rolls through a rolling contact.

Also shown in FIG. 1 there is a support surface 150 for the print media 112, over which printing takes place and which includes a printing area on which printing is performed by the print-head 108. The support surface 150 is located in a space between the drive-roll 124 and the tension-providing-roll 132. The print media 112, after having been printed, may be collected on a collection-roll 154, or it may be collected as free-falling.

The printer 100 further includes a control unit 158 which is arranged for controlling the rotation speed of all the rolls, the operation of the drying/curing heat system, all the units, and, of course, the printing process itself, i.e. receiving, processing and generating image-representing data and forwarding them to the print-head 108.

The substrate or print media 112, as a web, is threaded through the substrate feed-path from the substrate supply-roll 116, on which the print media 112 is stored, through the first pressure-roll 128 and the substrate drive-roll 124 and over the support surface 150 where the printing takes place in the printing area. In operation, the substrate drive-roll 124 is caused to rotate at a first speed, and the tension-providing-roll 132 is caused to rotate at a second, different, speed which is higher than the first rotation speed, and the difference in the rotation speeds of the two rolls 124, 132 generates a constant tension (back tension) as a force which keeps the substrate 112 flat in a section of a web of substrate or print media 112 located between the spaced apart drive-roll 124 and tension-roll 132 and including the printing area on the support surface 150. The web of substrate 112 is pulled over the support surface 150 past the tension-providing-roll 132 and the second pressure-roll 136, as shown by the arrow in FIG. 1, towards the substrate collection-roll 154.

In the course of printing, at each pass or stroke of the print-head 108, the substrate or print media 112 is advanced in a step-wise manner wherein the step typically is equal to the width at each stroke or pass of the print-head 108. The surface 150 located between the tension-providing-roll 132 and the substrate drive-roll 124 supports the tensioned web of substrate 112 in the printing area.

Figure 1A:
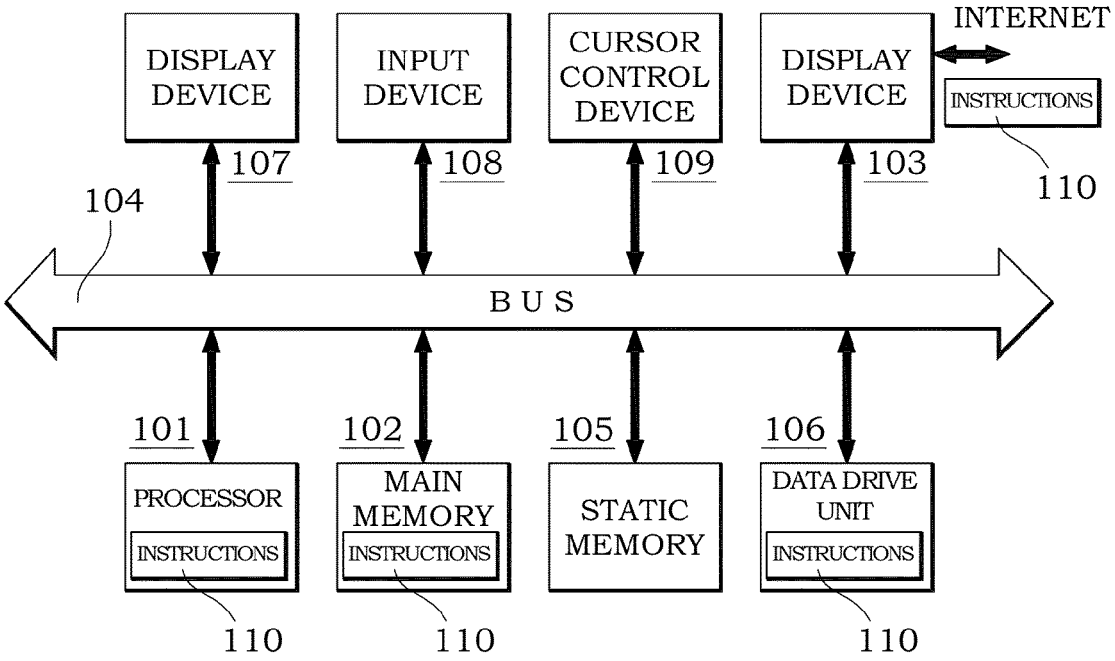
FIG. 1*a*) is a diagrammatic representation of a computer system as it may be arranged to provide the functionality of a controller implemented in the printer.

FIG. 1*a* is a diagrammatic representation of an example of a computer system as it may be arranged to provide the functionality of the controller 158 in FIG. 1. The computer system is configured to execute a set of instructions so that the controller 158 is able to perform the described tasks for the printer. The computer system includes a processor 101 and a main memory 102, which communicate with each other via a bus 104. Optionally, the computer system may further include a static memory 105 and/or a non-transitory memory 106 which may be a solid-state memory or a disk-drive unit. A display device 107, an alpha-numeric input device 108 and a cursor-control device 109 may form a user interface. Additionally, a network-interface device 103 may be provided to connect the computer system to an Intranet or to the Internet. A set of instructions (i.e. software) 110 embodying any one, or all, of the controller tasks described herein, may reside completely, or at least partially, in or on a machine-readable medium, e.g. the main memory 102 and/or the processor 101. A machine-readable medium on which the software 110 resides may also be a data carrier 111 (e.g. a solid-state data drive, a non-removable magnetic hard disk or an optical or magnetic removable disk) which is part of the data drive unit 106.

Figure 2:
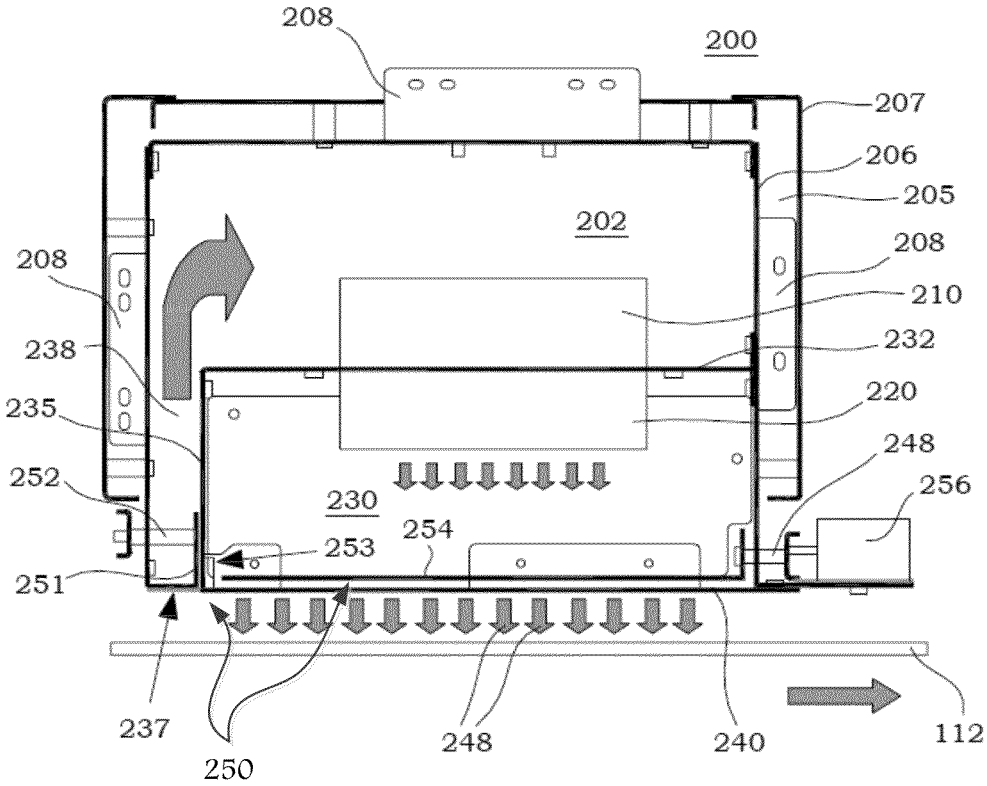
FIG. 2 is a schematic cross-section of a heating system of an example.

FIG. 2 shows a schematic cross-section through a heating system 200 of a printer 100 as indicated in FIG. 1. The heating system 200 is arranged to produce a hot-air flow which impinges on the print media 112. The heating system 200 includes a heat source 220, a fan 210, and an air chamber 230 for slightly pressurized air which is delivered by the fan 210 through the heater 220 into the air chamber 230. The pressure range of the slightly pressurized air in the chamber 230 will depend on the specifications of the printer. The heat source 220 may be heated by appropriate energy, for example by electrical current. Typically, the heat source 220 used for the fan/heater convection system as exemplified here may be a coil heater.

A housing 205 of the heating system 200, which may include an inner wall 206 and an outer wall 207 for thermal insulation (an insulation material can be placed between the inner and outer walls 206 and 207), as shown in the example of FIG. 2, confines partially the pressurized-air chamber 230 and a recirculation chamber 202 which is arranged upstream of the fan 210. The pressurized-air chamber 230 is separated from the recirculation chamber 202 by a separation wall 232 through which the air stream from the van 210 to the heater 220 passes. The pressurized-air chamber 230 further is confined by an air-impinging plate 240 which is arranged adjacent to the print media 112 and which includes a number of air-impinging holes or openings 242; 244 which are arranged to direct hot air from the pressurized-air chamber 230 to the print media 112 to be heated in the course of printing operation.

At the left side of the example shown in FIG. 2, an air-recirculation duct 238 is separated from the pressurized-air chamber 230 by a sidewall 235 of the same. The air-recirculation duct 238 further is confined by the housing 205 of the heating system 200. At the lower end of the air-recirculation duct 238, an air-inflow opening 237 is provided, and in the sidewall 235 between the air-recirculation duct 238 and the pressurized-air chamber 230, an air-recirculation opening 253 is provided.

A circuit-switching device for the hot-air flow includes a shutter blade 251 which is arranged to open either the air-inflow opening 237 or the air-recirculation opening 253. The shutter blade 251 is mounted on a shaft 252 so that rotation of the shaft 252 also causes rotation of the shutter blade 251, so that either the air-inflow opening 237 is opened and the air-recirculation opening 253 is closed, or—vice versa—the air-recirculation opening 253 is opened and the air-inflow opening 237 is closed. In the example of FIG. 2, the air-inflow opening 237 opens near the air-impinging plate 240 adjacent to the print media 112. Alternatively, instead of a rotation, as by the shaft 252, the shutter blade 251 also can be arranged for translation to open or close, respectively, the air-inflow opening 237 and the air-recirculation opening 253.

Figure 3A:
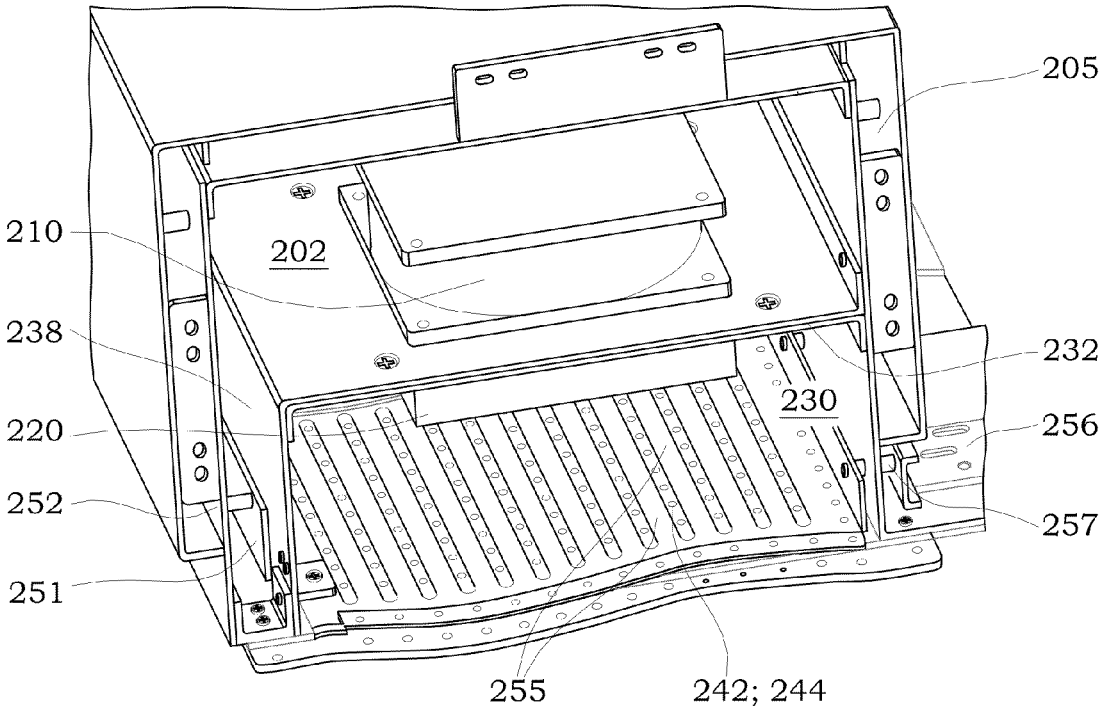
FIGS. 3*a*) and *b*) are schematic perspective views of a partially broken heating system of an example which show air-impinging holes in an air-impinging plate which is arranged to direct a hot-air flow to heat a print media, in an open condition and in a closed condition, respectively.

Further, the circuit-switching device for the hot-air flow includes a sliding plate 254 which is arranged parallel to the air-impinging plate 240 and which includes a number of trap slides 255 arranged in parallel and spaced at a given distance, as can be seen in FIGS. 3*a*) and *b*). The air-impinging holes 242; 244 are provided in a number of rows in the air-impinging plate 240. The rows are arranged in parallel and the centers of the rows are spaced at a distance which corresponds to the distance between the centers of the sliding traps 255 of the sliding plate 254. On the other hand, the diameter or the width of the air-impinging holes 242; 244 corresponds to, or is smaller than, the width of the sliding traps 255 of the sliding plate 254 so that the air-impinging holes 242; 244 can be closed by the sliding traps 255 of the sliding plate 254 when in the position shown in FIG. 3*b*).

Figure 3B:
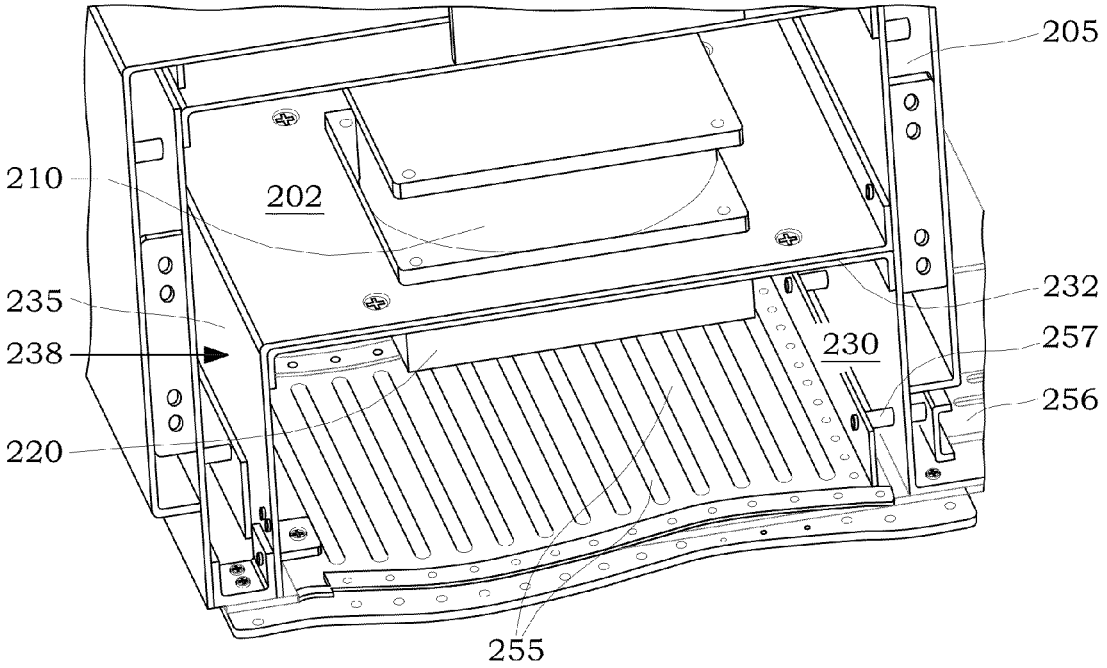

The sliding plate 254 is coupled to a sliding-plate actuator 256 by a sliding plate drive connection or gear 257. By means of the sliding-plate actuator 256, the sliding plate 254 is displaceable between a first position which is shown in FIG. 3*a*), wherein the air-impinging openings 242; 244 in the air-impinging plate 240 are opened, so that hot air from within the pressurized-air chamber 230 can be directed to the print media 112 to be heated, and a second position which is shown in FIG. 3*b*) wherein the air-impinging openings 242; 244 are closed.

Figure 6A:
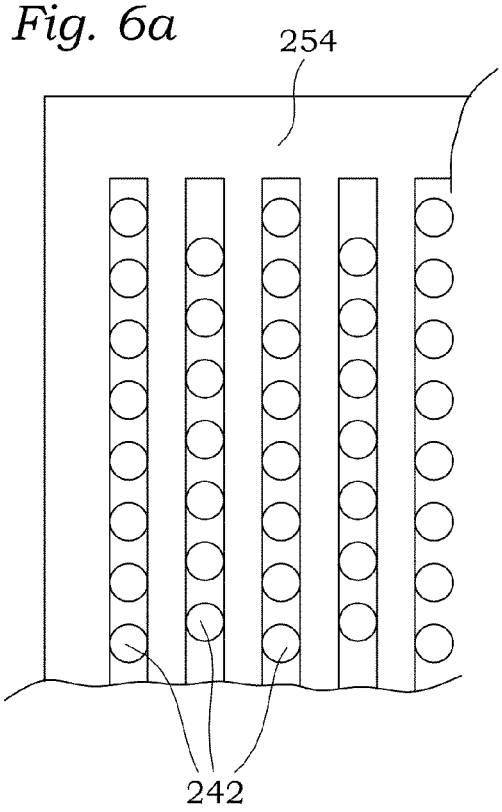
FIGS. 6*a*) and *b*) and FIGS. 6*c*) and *d*) show examples of air-impinging holes provided in the air-impinging plate as shown in FIGS. 3*a*) and *b*).
Figure 6B:
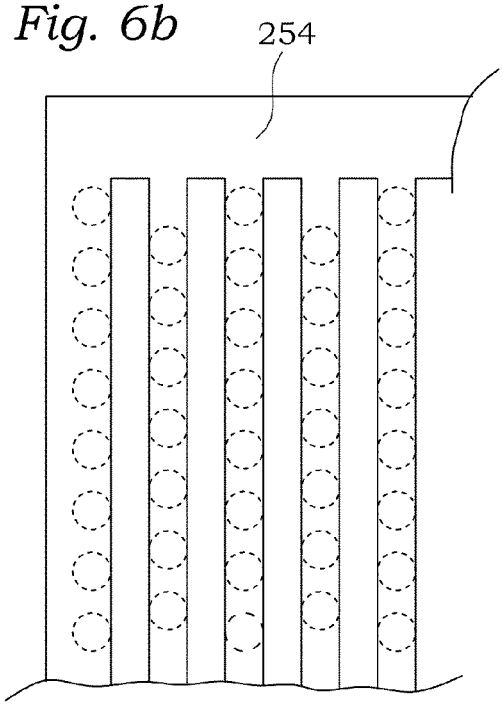
Figure 6C:
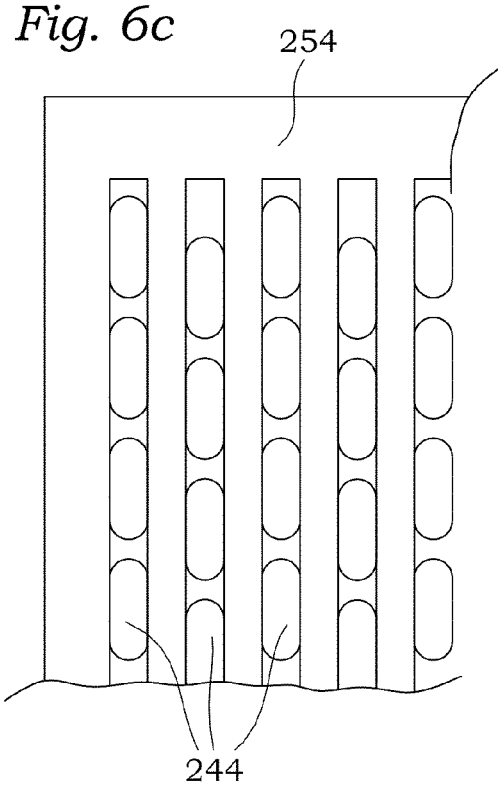

Examples of the air-impinging holes 242, 244 provided in the air-impinging plate 240 are shown in FIGS. 6*a*) and *b*) and in FIGS. 6*c*) and *d*). In the example shown in FIG. 6*a*) and *b*), the air-impinging holes 242 are circular openings which are arranged in parallel rows and which can be opened—FIG. 6*a*)—and closed—FIG. 6*b*)—by the trap slides 255 of the sliding plate 254. In the example shown in FIGS. 6*c*) and *d*), the air-impinging holes 244 are elongated, slit-like openings which also are arranged in parallel rows and can be opened—

Figure 6D:
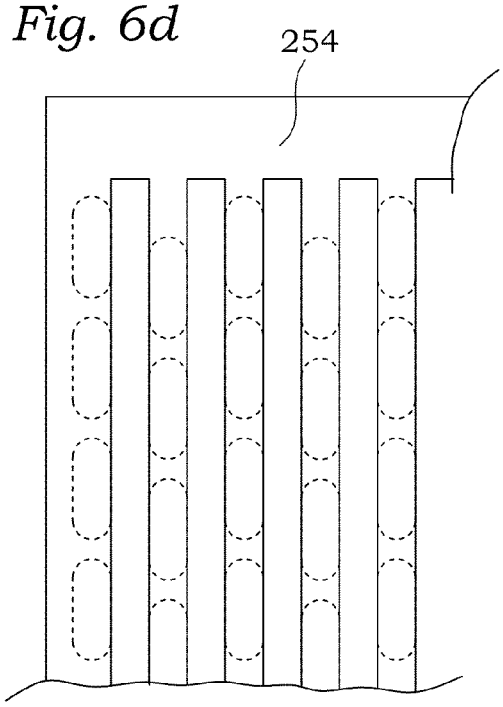

FIG. 6)—and closed—FIG. 6*d*)—by the trap slides 255 of the sliding plate 254, as described above with reference to FIGS. 3*a*) and *b*).

When the circuit-switching device is operated, the hot-air flow in the heating system 200 can be switched between first and second hot-air circulation circuits: a first hot-air circulation circuit leads from the heater 220 and the pressurized-air chamber 230, driven by the fan 210, through the air-impinging holes 242, 244 of the air-impinging plate 240 so that hot air is directed through the air-impinging holes 242, 244 to the adjacent print media 112 in the course of the printing operation. The air which is delivered by the fan 210 through the heater 220 into the pressurized-air chamber 230 is sucked from the air-inflow opening 237 through the recirculation chamber 202, wherein the shutter blade 251 of the circuit-switching device 250 opens the air-inflow opening 237. The position of the sliding plate 254 of the circuit-switching device 250 corresponds to that which is shown in the FIGS. 3*a*) and 6*a*) or 6*c*), leaving the air-impinging holes 242; 244 of the air-impinging plate 240 opened.

In a second position of the circuit-switching device 250, the air-impinging holes 242; 244 in the air-impinging plate 240 are closed by the trap slides 255 of the sliding plate 254, as shown in FIG. 3*b*), and the shutter blade 251 is in a position such that the air-inflow opening 237 is closed and the recirculation opening 253 in the sidewall 235 of the pressurized-air chamber 230 is open. In this position, a second hot-air circulation circuit is established which leads from within the pressurized-air chamber 230 back to the heater 220 via the air-recirculation duct or channel 238, driven by the fan 210, without passing through the air-impinging holes 242; 244 of the air-impinging plate 240. In this position of the sliding plate 254, air is prevented from being directed onto the print media, in the course of the heating-up operation of the heating system 200. This position of the sliding blade 254 corresponds to that shown in FIG. 3*b*) or in FIGS. 6*b*) and 6*d*).

Figure 4A:
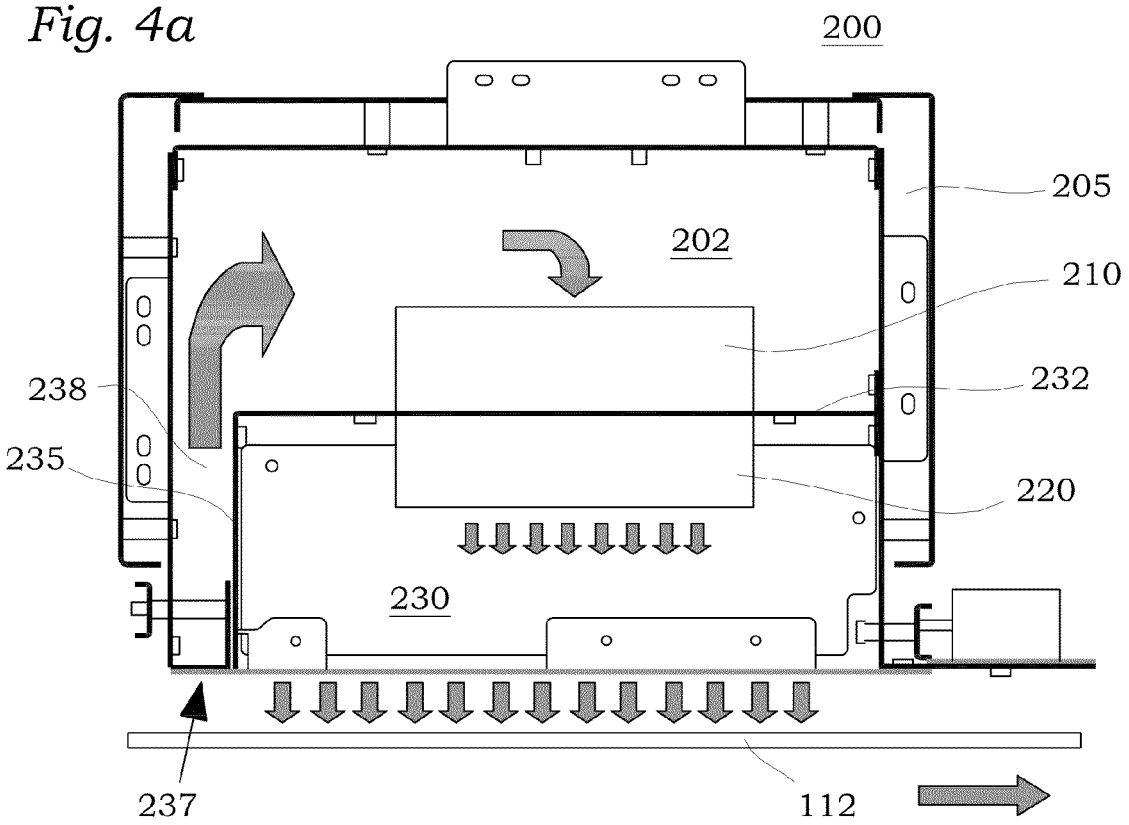
FIGS. 4*a*) and *b*) show cross-sections through the heating system of the example shown in FIG. 2 switched to a first hot-air circulation circuit and switched to a second hot-air circulation circuit, respectively, according to an example.

FIGS. 4*a*) and *b*) show the switching between the first and second hot-air circulation circuits of a first example. In FIG. 4*a*) the circuit-switching device for the hot-air flow is in the first position, wherein the first hot-air circulation circuit, as shown by the arrows, leads from the heater 220 through the pressurized-air chamber 230 to the holes of the air-impinging plate 240 so that hot air is directed to the print media 112. As already described above, the air is sucked by the fan 210 from the air-inflow opening 237 through the recirculation channel 238 into the recirculation chamber 202. The air-inflow opening 237, in the example shown in FIGS. 4*a*) and *b*), is arranged near the air-impinging plate 240 adjacent to the print media 112, as shown in FIG. 2, so that part of the hot air from the print media 112 is recirculated to the heating system 200.

Figure 4B:
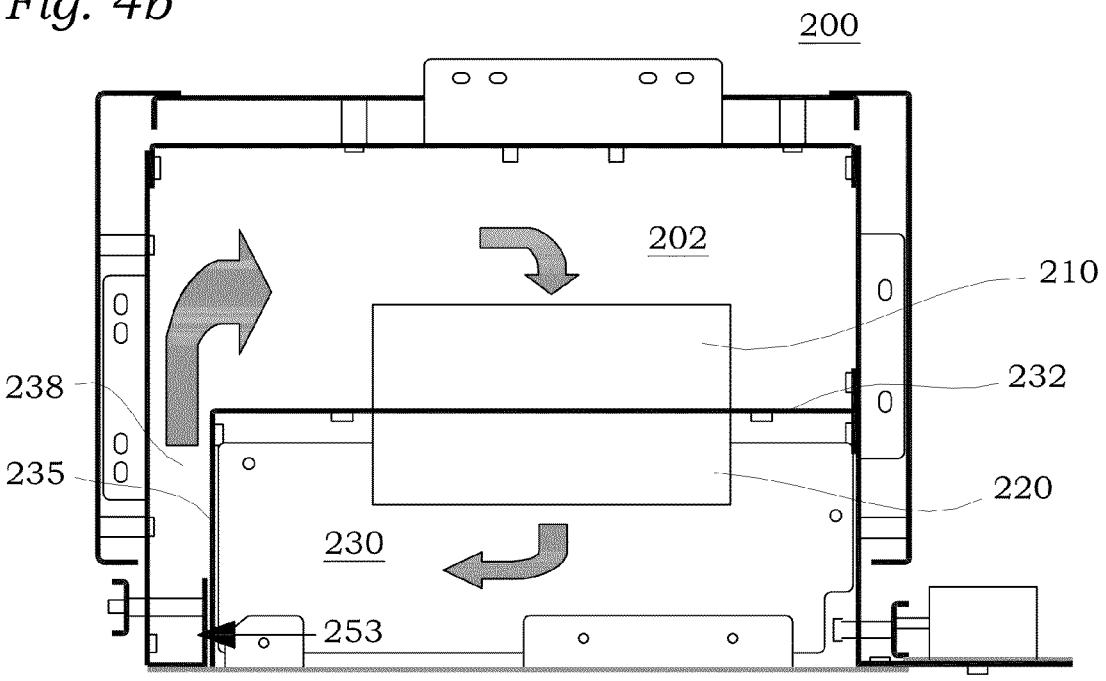

In FIG. 4*b*) the circuit-switching device for the hot air is in the second position wherein the second hot-air circulation circuit leads from inside the pressurized-air chamber 230 through the recirculation opening 253 of the recirculation channel 238 back to the heater 220, driven by the fan 210, without passing through the holes 242; 244 of the air-impinging plate 240. So, hot air is circulated within the heating system 200 during the heating-up operation or when a printing operation is not in process.

Figure 5A:
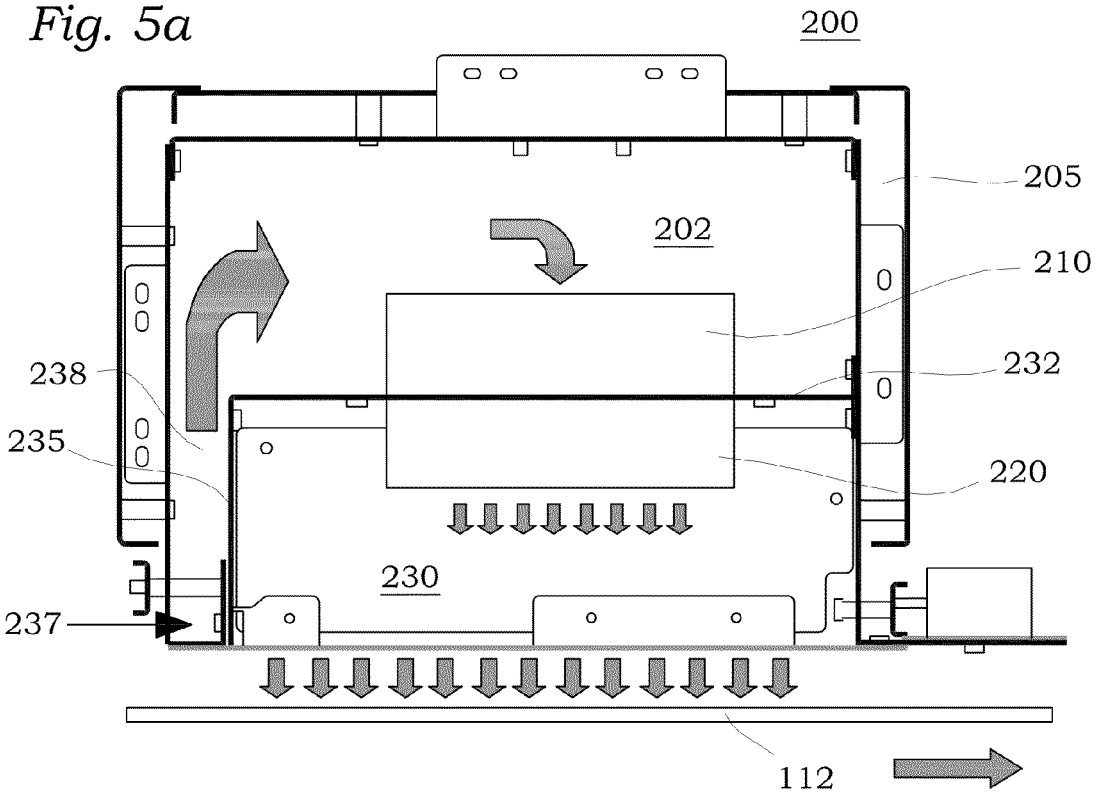
FIGS. 5*a*) and *b*) show cross-sections through the heating system of the example shown in FIG. 2 switched to a first hot-air circulation circuit and switched to a second hot-air circulation circuit, respectively, according to another example.

FIGS. 5*a*) and *b*) show another example wherein an air-inflow opening 237 is arranged at a location away from the print media 112 to lead air into the recirculation chamber 202. In the position shown in FIG. 5*a*), the first hot-air circulation circuit leads hot air from the heater 220 through the holes 242; 244 of the air-impinging plate 240 and directs it to the print media 112 in the course of printing operation. The air is sucked by the fan 210 from the air-inflow opening 237 through the recirculation channel 238 into the recirculation chamber 202 and pressed through the heater 220 into the pressurized-air chamber 230.

Figure 5B:
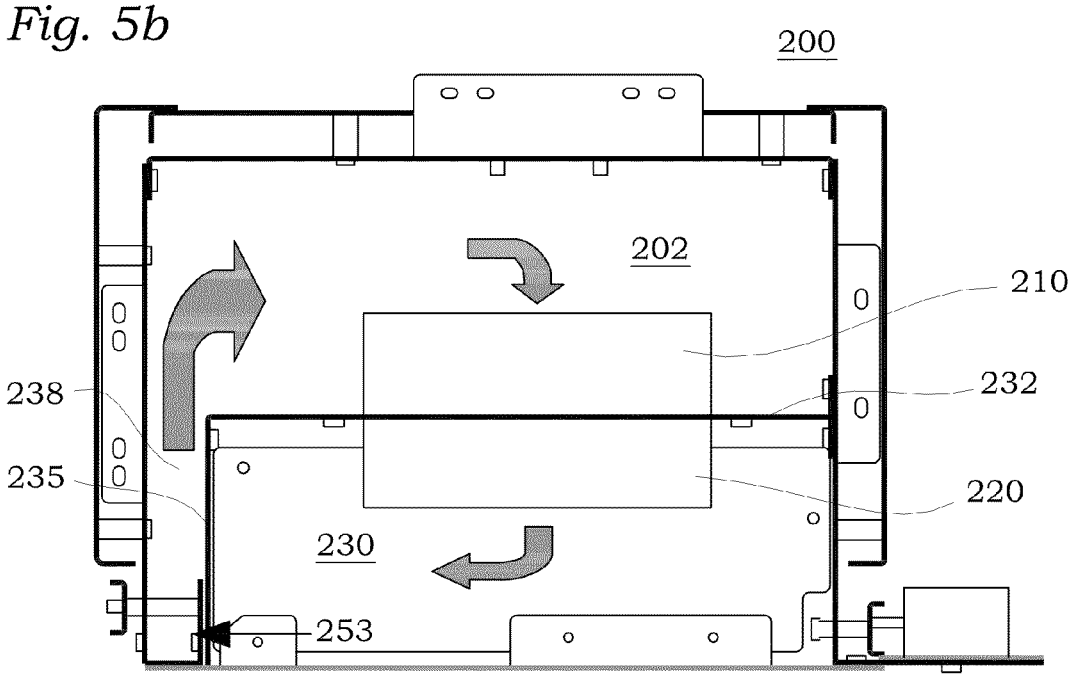

In the position shown in FIG. 5*b*), the air-inflow opening 237 is closed by the circuit-switching device 250 so that, similar to that shown in FIG. 4*b*), the circuit-switching device for the hot air is in the second position wherein the second hot-air circulation circuit leads from inside the pressurized-air chamber 230 through the recirculation opening 253 of the recirculation channel 238 back to the heater 220, driven by the fan 210, without passing through the holes 242; 244 of the air-impinging plate 240. This happens due to the different pressure drops between the opening 237 and the air impinging holes 242; 244. So, hot air is circulated within the heating system 200 during the heating-up operation or when a printing operation is not in process.

Now, some more general points of examples as described herein will be discussed:

Advantages of producing a hot-air flow as described to heat a print media is a reduction of warm-up time when the heating system is in the second hot-air circulation condition wherein hot air is led back to the heater without passing through the air-impinging plate. In this condition, the heater power also can be reduced when printer operation is not in process, while the air flow is not reduced.

The circuit-switching can be activated manually or automatically. When activated automatically, an integration in the printer control can be implemented.

In general, the heating system typically is arranged to dry and cure ink which is printed on the print media, for example current latex-based inks. With the hot-air impinging system, the drying and curing capability can be improved with a minimum media temperature.

According to one example, the circuit-switching device is arranged to close the flow through the recirculation channel when the air flow is switched to the first hot-air circulation circuit.

According to one example, the circuit-switching device is arranged to close the flow through the air-impinging holes of the air-impinging plate when the air flow is switched to the second hot-air circulation circuit.

According to one example, the first hot-air circulation circuit comprises an air-inflow opening leading air from outside into the air chamber.

According to one example, the circuit-switching device is arranged to open the air-inflow when the air flow is switched to the first hot-air circulation circuit.

According to one example, the circuit-switching device is arranged to close the air-inflow when the air flow is switched to the second hot-air circulation circuit.

According to one example, the air-inflow opening is arranged near the air-impinging plate adjacent to the print media so as to recirculate at least a part of the hot air, after it has been directed through the holes to the print media, back into the air chamber.

According to another example, the air-inflow opening is arranged away from the print media to lead air into the air chamber.

According to one example, the circuit-switching device comprises a set of sliding traps which are provided in the impinging plate and which are arranged to be moveable to open the air-impinging holes so as to direct the hot air through the air-impinging holes to the print media when switched to the first hot-air circulation circuit, and to close the air-impinging holes when switched to the second hot-air circulation circuit.

Herein the air-impinging holes can be provided in a number of rows in the air-impinging plate, wherein the rows are spaced in parallel at a distance corresponding to a distance at which the sliding traps are arranged to one another.

The air-impinging holes may be provided in the form of circular openings.

According to another example, the air-impinging holes are provided in the form of elongate, slit-like openings.

According to one example, the circuit-switching device is arranged to close the recirculation channel when the air flow is switched to the first hot-air circulation circuit, to open the recirculation channel when the air flow is switched to the second hot-air circulation circuit, wherein the first hot-air circulation circuit comprises an air-inflow opening leading air from outside into the air chamber, and the circuit-switching device is arranged to open the air-inflow when the air flow is switched to the first hot-air circulation circuit, and to close the air-inflow when the air flow is switched to the second hot-air circulation circuit.

According to one example, a method is provided of producing a hot-air flow in a printer to impinging on a print media, with a heat source, a fan and an air chamber comprising an air-impinging plate with air-impinging holes adjacent to the print media, the method providing first and second partially overlapping hot-air circulation circuits, wherein the first hot-air circulation circuit leads from the heater through the air-impinging holes of the air-impinging plate to direct hot air through the air-impinging holes to the print media in the course of printing operation, wherein the second hot-air circulation circuit leads back to the heater through a recirculation channel without passing through the air-impinging holes of the air-impinging plate to prevent air from being directed onto the print media, in the course of heating-up operation, and wherein the method further comprises circuit-switching to switch the air flow between the first and second hot-air circulation circuits.

According to one example, the circuit switching is to close the flow through the recirculation channel when the air flow is switched to the first hot-air circulation circuit, and to close the flow through the air-impinging holes of the air-impinging plate when the air flow is switched to the second hot-air circulation circuit.

According to one example, the first hot-air circulation circuit comprises an air-inflow which leads air from outside into the air chamber, wherein the circuit-switching is to open the air-inflow when the air flow is switched to the first hot-air circulation circuit, and to close the air-inflow when the air flow is switched to the second hot-air circulation circuit.

In an alternative example, the circuit-switching device can be designed such that the sliding plate 254 also includes the shutter blade 251 so that the flow through the air impinging holes 242; 244 in the air-impinging plate 242 and the flow through the air-inflow opening 237 and through the recirculation opening 253 all are controlled by the sliding plate 254, driven by the sliding-plate actuator 256, similar as shown in FIG. 2.

According to still another example, the heating system may include an impinging plate 240 in which the sliding traps 255 of the sliding plate 254 are provided in several sliding trap sections, similar as those of the sliding plate 254 shown in the FIGS. 6*a*) through 6*d*), which sliding plate sections are separated in the direction of the printhead movement axis, i.e. in the direction of the print media width. Then, depending on the media width printed, the sliding traps 255 can be closed or opened individually for each sliding plate section. The sliding traps 255 are closed where the print media is not present or where it is not printed, and they are opened where the media is being printed.

Although certain products and methods constructed in accordance with the teachings of the invention have been described herein, the scope of coverage of this patent is not limited thereto. On the contrary, this patent covers all embodiments of the teachings of the invention fairly falling within the scope of the appended claims either literally or under the doctrine of equivalents.

What is claimed is:

1. A printer comprising a heating system to produce a hot-air flow impinging on a print media, the heating system comprising a heat source, a fan, and an air chamber comprising an air-impinging plate with air-impinging holes adjacent to the print media, the heating system providing first and second partially overlapping hot-air circulation circuits, wherein the first hot-air circulation circuit leads from the heater through the holes of the air-impinging plate to direct hot air through the air-impinging holes to the print media in the course of printing operation, wherein the second hot-air circulation circuit leads back to the heater through a recirculation channel without passing through the air-impinging holes of the air-impinging plate to prevent air from being directed onto the print media, in the course of heat-up operation, and the heating system further comprises a circuit-switching device arranged to switch the air flow between the first and second hot-air circulation circuits.

2. The printer of claim 1, wherein the circuit-switching device is arranged to close the flow through the recirculation channel when the air flow is switched to the first hot-air circulation circuit.

3. The printer of claim 1, wherein the circuit-switching device is arranged to close the flow through the air-impinging holes of the air-impinging plate when the air flow is switched to the second hot-air circulation circuit.

4. The printer of claim 3, wherein the circuit-switching device comprises a set of sliding traps which are provided in the impinging plate and which are arranged to be moveable to open the air-impinging holes so as to direct the hot air through the air-impinging holes to the print media when switched to the first hot-air circulation circuit, and to close the air-impinging holes when switched to the second hot-air circulation circuit.

5. The printer of claim 4, wherein the air-impinging holes are provided in a number of rows in the air-impinging plate, wherein the rows are spaced in parallel at a distance corresponding to a distance at which the sliding traps are arranged to one another.

6. The printer of claim 4, wherein the air-impinging holes are provided in the form of circular openings.

7. The printer of claim 4, wherein the air-impinging holes are provided in the form of elongate, slit-like openings.

8. The printer of claim 4, wherein the first hot-air circulation circuit comprises an air-inflow opening leading air from outside into the air chamber, wherein the circuit-switching device is arranged to open the air-inflow when the air flow is switched to the first hot-air circulation circuit, wherein the circuit-switching device is arranged to close the air-inflow when the air flow is switched to the second hot-air circulation circuit, and wherein the circuit-switching device is designed such that the sliding plate also includes a shutter blade which is arranged to alternatively open and close the flow through the air-inflow opening and through the recirculation channel so that the flow through the air impinging holes in the air-impinging plate and the flow through the air-inflow opening and the flow through the recirculation opening in common are controlled by the sliding plate.

9. The printer of claim 4, wherein the heating system includes an air-impinging plate in which the sliding traps are provided in several sliding trap sections, which sliding trap sections are separated in the direction of printing media width, wherein, depending on the media width printed, the sliding traps are arranged to be closed or opened individually for each sliding plate section.

10. The printer of claim 1, wherein the first hot-air circulation circuit comprises an air-inflow opening leading air from outside into the air chamber.

11. The printer of claim 10, wherein the circuit-switching device is arranged to open the air-inflow when the air flow is switched to the first hot-air circulation circuit.

12. The printer of claim 10, wherein the circuit-switching device is arranged to close the air-inflow when the air flow is switched to the second hot-air circulation circuit.

13. The printer of claim 10, wherein the air-inflow opening is arranged near the air-impinging plate adjacent to the print media so as to recirculate at least a part of the hot air, after it has been directed through the holes to the print media, back into the air chamber.

14. The printer of claim 10, wherein the air-inflow opening is arranged away from the print media.

15. The printer of claim 1, wherein the circuit-switching device is arranged to close the recirculation channel when the air flow is switched to the first hot-air circulation circuit, to open the recirculation channel when the air flow is switched to the second hot-air circulation circuit, wherein the first hot-air circulation circuit comprises an air-inflow opening leading air from outside into the air chamber, and the circuit-switching device is arranged to open the air-inflow when the air flow is switched to the first hot-air circulation circuit, and to close the air-inflow when the air flow is switched to the second hot-air circulation circuit.

16. A method of producing a hot-air flow in a printer impinging on a print media, with a heat source, a fan and an air chamber comprising an air-impinging plate with air-impinging holes adjacent to the print media, the method providing first and second partially overlapping hot-air circulation circuits, wherein the first hot-air circulation circuit leads from the heater through the air-impinging holes of the air-impinging plate to direct hot air through the air-impinging holes to the print media in the course of printing operation, wherein the second hot-air circulation circuit leads back to the heater through a recirculation channel without passing through the air-impinging holes of the air-impinging plate to prevent air from being directed onto the print media, in the course of the heating-up operation, and the method further comprises circuit-switching to switch the air flow between the first and second hot-air circulation circuits.

17. The method of claim 16, wherein the circuit switching is to close the flow through the recirculation channel when the air flow is switched to the first hot-air circulation circuit, and to close the flow through the air-impinging holes of the air-impinging plate when the air flow is switched to the second hot-air circulation circuit.

18. The method of claim 16, wherein the first hot-air circulation circuit comprises an air-inflow which leads air from outside into the air chamber, wherein the circuit-switching opens the air-inflow when the air flow is switched to the first hot-air circulation circuit, and closes the air-inflow when the air flow is switched to the second hot-air circulation circuit.

* * * * *